US006487808B1

(12) United States Patent
Carey

(10) Patent No.: US 6,487,808 B1
(45) Date of Patent: Dec. 3, 2002

(54) COMBINATION SPENT SHELL DEFLECTOR AND CATCHER, AND BREECH BLOCK ACTUATOR

(76) Inventor: Donald C. Carey, 11430 Payette Hts. Rd., Payette, ID (US) 83661

( * ) Notice: Subject to any disclaimer, the term of this patent is extended or adjusted under 35 U.S.C. 154(b) by 11 days.

(21) Appl. No.: 09/664,633

(22) Filed: Sep. 19, 2000

(51) Int. Cl.[7] ..... F41A 15/00
(52) U.S. Cl. ..... 42/98
(58) Field of Search ..... 89/33.4; 42/98

(56) References Cited

U.S. PATENT DOCUMENTS

| | | | | | |
|---|---|---|---|---|---|
| 3,087,387 | A | * | 4/1963 | Browning | 89/33 |
| 3,153,296 | A | * | 10/1964 | Hofstetter | 42/87 |
| 3,270,617 | A | * | 9/1966 | Seymour et al. | 89/33 |
| 3,609,900 | A | * | 10/1971 | Bernocco, Jr. | 42/1 |
| 3,656,400 | A | * | 4/1972 | Stoner et al. | 89/138 |
| 3,739,685 | A | * | 6/1973 | Lundgren | 89/33 |
| 3,755,946 | A | | 9/1973 | Tomlinson et al. | 42/1 R |
| 3,807,075 | A | * | 4/1974 | Mylonas | 42/1 |
| 3,881,268 | A | * | 5/1975 | Petersen | 42/1 |
| 3,893,253 | A | * | 7/1975 | Weatherby et al. | 42/1 |
| 3,916,867 | A | * | 11/1975 | Marshall | 124/16 |
| 3,978,602 | A | * | 9/1976 | Morrow et al. | 42/1 |
| 4,166,333 | A | * | 9/1979 | Kratzer | 42/1 |
| 4,384,421 | A | * | 5/1983 | Rodgers | 42/1 |
| 4,621,444 | A | * | 11/1986 | Anderson | 42/98 |
| 4,715,141 | A | * | 12/1987 | Kohnke | 42/98 |
| 5,605,002 | A | | 2/1997 | Carey | 42/17 |
| 6,173,520 | B1 | * | 1/2001 | Bucciarelli et al. | 42/98 |

* cited by examiner

*Primary Examiner*—Michael J. Carone
*Assistant Examiner*—Denise J Buckley
(74) *Attorney, Agent, or Firm*—Pedersen & Co., PLLC; Ken J. Pedersen; Barbara S. Pedersen

(57) ABSTRACT

The present invention is a combination spent shell deflector and catcher, and breech block latch actuator, or receiver closer for semi-automatic firearms. The combination comprises a generally planar frame for attachment in vertical orientation to the side of the gun's receiver, and generally parallel therewith, in the area of the ejector port. The planar frame of the invention has an upper section extending back from the front of the frame which supports a resilient plug near the upper edge of the ejection port. Also, the planar frame has a lower section extending back from the front of the frame supporting a pivotal connection for a breach block latch actuator. The latch actuator is a moveable, generally flat panel which fits within the front part of the lower section of the planar frame. Also, the lower section of the planar frame supports a removable connection for a spent shell catcher. The spent shell catcher is a generally planar tab with an upper portion which is a generally planar platform which is oriented substantially perpendicular to the lower portion of the catcher. This way, the upper portion of the shell catcher, when the catcher is installed on the gun, extends into the ejection port opening.

19 Claims, 5 Drawing Sheets

COMBINATION SPENT SHELL DEFLECTOR AND CATCHER, AND BREECH BLOCK ACTUATOR

BACKGROUND OF THE INVENTION

1. Field of the Invention

This invention relates generally to firearms. More specifically, this invention relates to a combination shell deflector and catcher, breech block actuator (or receiver closer) for semi-automatic shotguns.

2. Related Art

In the past, some semi-automatic shotguns have included a spent shell deflector located at the top edge of the ejector port in the side of the receiver of the gun. This conventional deflector is often simply a downwardly-extending metal bump in the top edge of the ejector port. The metal bump is in the flight path of the ejected spent shell, causing the shell to be deflected slightly downwardly so that the ejected shell does not interfere with neighboring shooters, and so that the ejected shell does not travel too far away.

In the past, devices have been made to prevent a shell from being completely ejected, for example, if the user wishes to grasp the spent shell in his/her hand before it flies out of the ejector port. U.S. Pat. No. #3,755,946 (Tomlinson, et al.) discloses a clip-on shell catcher for semi-automatic shotguns. This catcher is a generally C-shaped clip that snaps onto and off of the side of the gun at the bottom edge of the ejector port. The top edge of the Tomlinson et al. shell catcher extends above the bottom edge of the ejection port of the gun to restrict an ejected shell from passing completely through the port.

In the past, a device has been made to assist the gun user in operating the release button of the breech block latch on the side of a semi-automatic shotgun. U.S. Pat. No. 5,605,002 (Carey) discloses an oversized actuator for operating the release button, which actuator takes the form of a lever that may be pivoted to push on the button. The lever is an elongated member which accommodates one or more fingers of the user more comfortably than the typically small release button on the gun. The Carey actuator is bolted to the forward end wall of the receiver housing.

Still, there is a need for a device that incorporates and improves upon several of the convenience factors previously available only separately as individual features. There is a need for a conveniently installed, economical, attractive, safe and effective combination system that may include a spent shell deflector, spent shell catcher, and breech block latch actuator or "receiver closer." This invention addresses that need.

SUMMARY OF THE INVENTION

The present invention is a combination unit for use with a semi-automatic shotgun, which combines an improved spent shell deflector, an improved spent shell catcher, and an improved breech block latch actuator, which is also called a "receiver closer." Therefore, the apparatus of this invention may perform up to three (3) functions—spent shell deflector, spent shell catcher, and receiver closer. To the inventor's knowledge, these three functions are not available in one apparatus in the prior art, and are not available in such a convenient and effective structure. Furthermore, the present invention obtains these three functions in a structurally efficient, simple and economical manner. For example, the present invention does not have to be manufactured into the top edge of the ejector port as does the prior art metal bump "deflector." Also, the present invention performs the objectives of both the Tomlinson et al. shell catcher and the Carey receiver closer, discussed above, with minimal additional structure.

The present invention comprises a generally planar frame for attachment in vertical orientation to the side of the gun's receiver, and generally parallel therewith, in the area of the ejector port. The attachment may be made by screws or bolts into, or adhesive onto, the side of the receiver, or by a friction fit, for example, into the space between the front end wall of the receiver housing and the gun's forearm. The preferred attachment is to have one end of the frame, typically the rear end, attached to the gun by a pin or screw already extending into the gun surface for other purposes, for example, by extending the pin to also pass through an aperture in the frame. The preferred attachment of the other end of the frame is to have the other end of the frame, the front end, attached securely to the gun surface by a double-sided adhesive tape. Other conventional attachments may also be made.

The planar frame of the invention has an upper section extending back from the front of the frame which supports a resilient plug near the top edge of the ejection port. Preferably, the resilient plug is removable, for replacement of the plug or adjustment of the plug size or material type. Also, preferably the plug is adjustable, by cutting or trimming, for example, or by moving in and out, out the way of the flight path of an ejected shell. A preferred plug extends about ¼–½ inch towards the lower section of the frame, in the plane of the frame.

Also the planar frame has a lower section extending back from the lower front of the frame. This lower section supports a pivotal connection for a breach block latch actuator. The latch actuator is a moveable, generally flat panel that fits within the front part of the lower section of the planar frame. Preferably, the latch actuator panel is pivotally hinged at its front end, and free to move in and out of the plane of the frame at its back end, on an axis near its front end that is parallel to the surface of the gun in that region. Preferably, on the inside surface of the latch actuator panel is an integral, raised bump or pad adapted to cooperate with the release button on the side of the receiver for effectively applying pressure on the button to operate the breech block latch. Thus, when the actuator panel is depressed by the user, it pivots inward to push on and actuate the release button, and, when the actuator panel is released by the user, the panel pivots out again due to the biasing mechanism of the release button and/or any bias built into the pivot hinge of the latch actuator.

Also, the lower section of the planar frame supports a removable connection for a spent shell catcher. The spent shell catcher has a lower portion, which is adapted preferably for slidable connection to the planar frame in such a manner than retains the shell catcher from any significant outward movement or upward/downward movement when in use. The lower portion of the shell catcher is a generally planar tab adapted to be securely received by the removable connection near the back end of the lower section of the planar frame. The upper portion of the shell catcher is a generally planar platform which is oriented substantially perpendicular to the lower portion of the catcher. This way, the upper portion of the shell catcher, when the catcher is installed on the gun, extends into the ejection port opening to an extent that it "interferes" with the spent shell to stop the shell in a position partly extending from the port, but not to such an extent that it interferes with the action of the port or breech actuator.

DESCRIPTION OF THE PREFERRED EMBODIMENTS

Figure 1A:
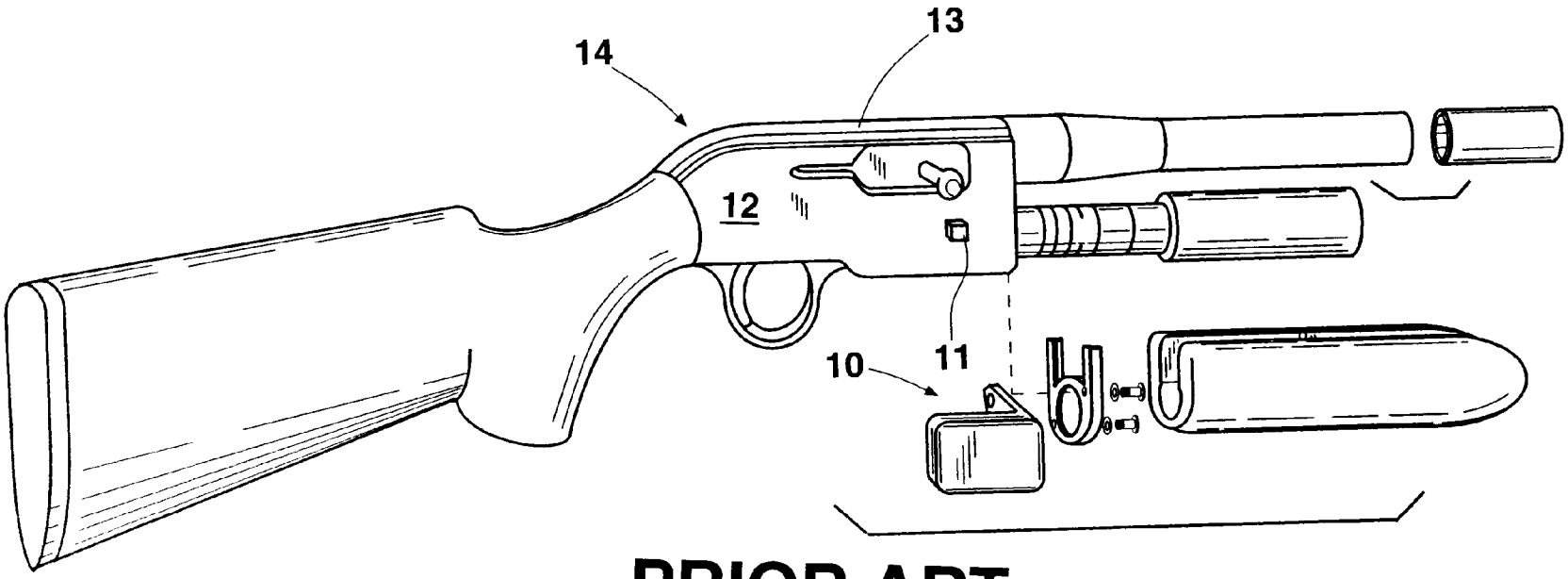
PRIOR ART FIG. 1A
FIG. 1A is a perspective, exploded view of the prior art Carey device.

Referring to FIG. 1A, there is depicted a perspective, exploded view of the prior art Carey device, an oversize actuator 10 for operating the release button 11 on the side surface 12 of receiver 13 of semi-automatic shotgun 14. The Carey actuator is bolted to the forward end wall of the receiver 14.

Figure 1B:
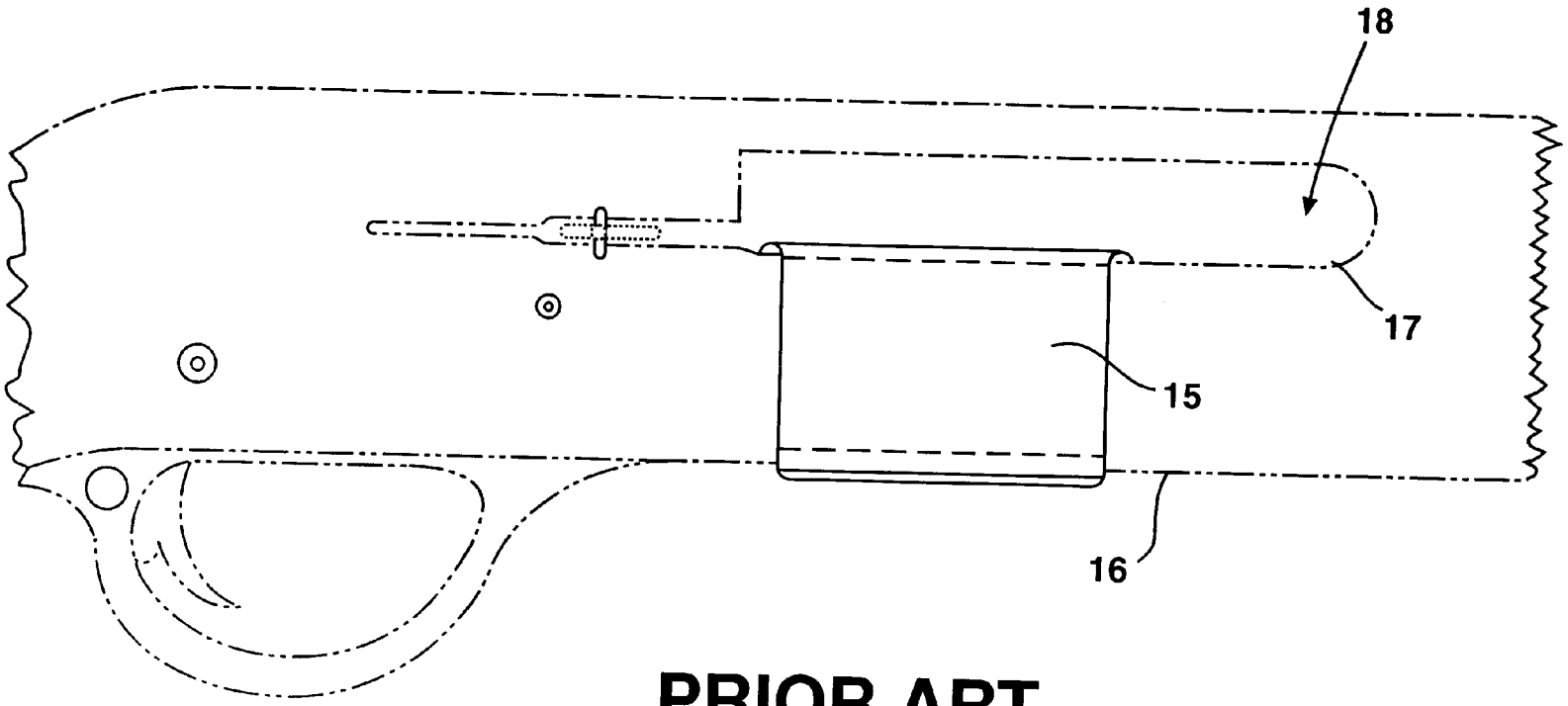
PRIOR ART FIG. 1B
FIG. 1B is a side view of the prior art Tomlinson et al. device.

Referring to FIG. 1B, there is depicted a side view of the prior art Tomlinson et al. device. Catcher 15 flexes and springs over both the lower edge 16 of the receiver of the gun and the bottom edge 17 of ejection port 18.

Figure 2:
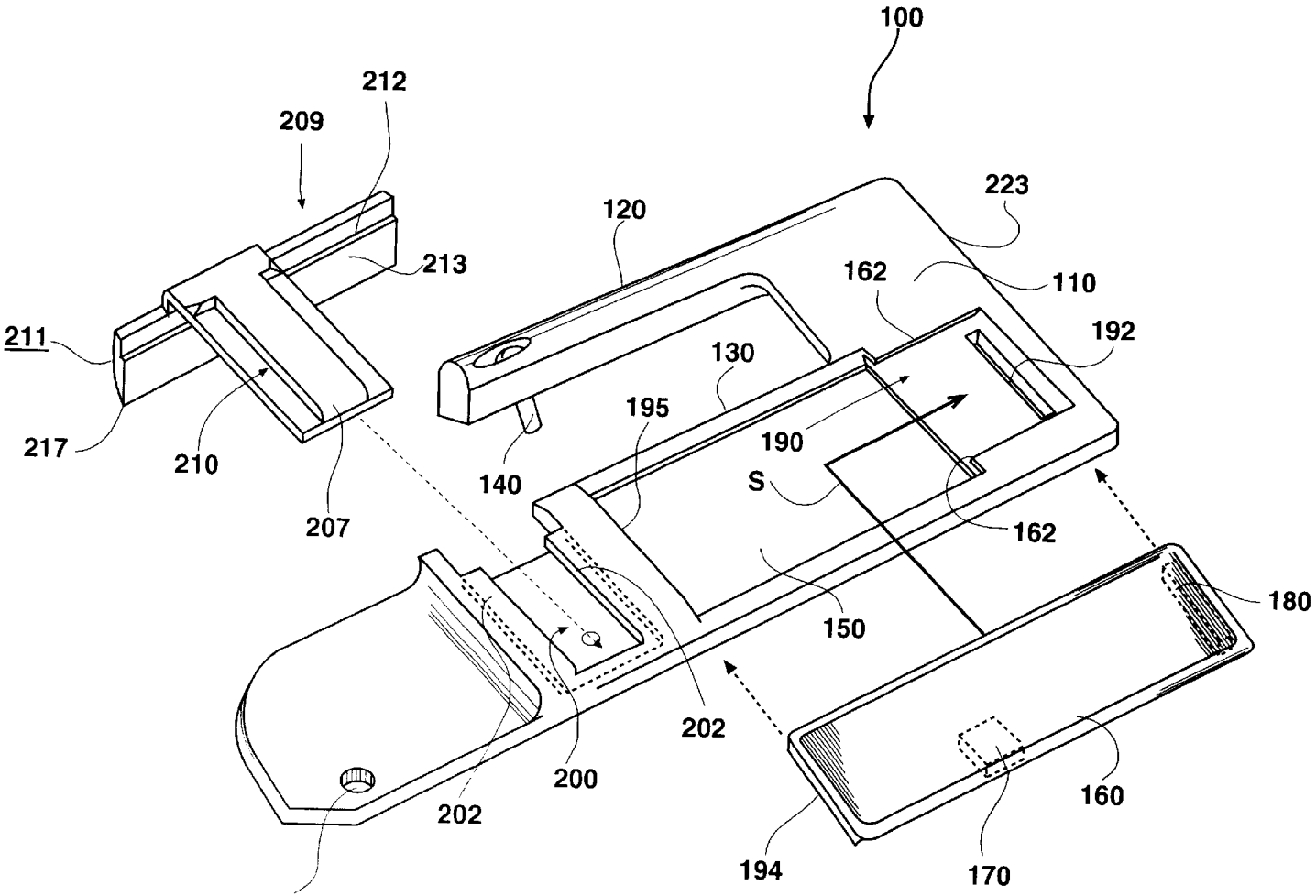
FIG. 2 is a perspective, exploded view of one embodiment of the combination deflector, catcher and receiver closer of the invention.
Figure 3:
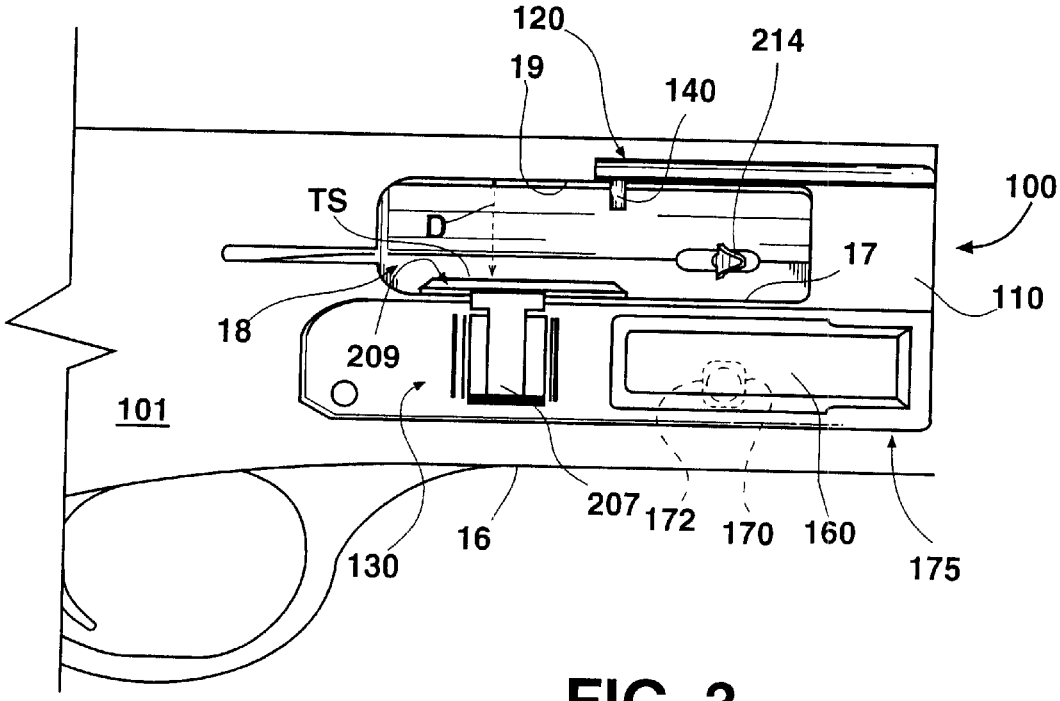
FIG. 3 is a partial side view showing the embodiment of the invention depicted in FIG. 2 attached to the side of the receiver of a gun.

Referring to FIG. 2, there is depicted a perspective, exploded view of one embodiment of the combination deflector, catcher and receiver closer unit 100 of the invention, also referred to herein as the "combination" or "combination unit." Combination 100 has generally planar frame 110, with upper section 120 and lower section 130. Both upper and lower sections 120 and 130, respectively, extend back from the front of the frame 110, and, in the preferred embodiment, generally form a "C-shape" with the upper section 120 and lower section 130 extending backwards on the shotgun side surface 101 near the top edge 19 and the bottom edge 17 of the ejection port, respectfully. Upper section 120 supports a resilient plug 140 near the distal end of upper section 120. Plug 140 is located on upper section 120 so that, when frame 110 is mounted on the gun, plug 140 is located near the top edge of the ejection port and generally midway along the length of the ejection port. This way, the plug 140 is in the flight path of the ejected shell, and directs the shell downwardly upon impact with it so that the shell does not fly far away from the user of the gun.

Figure 4:
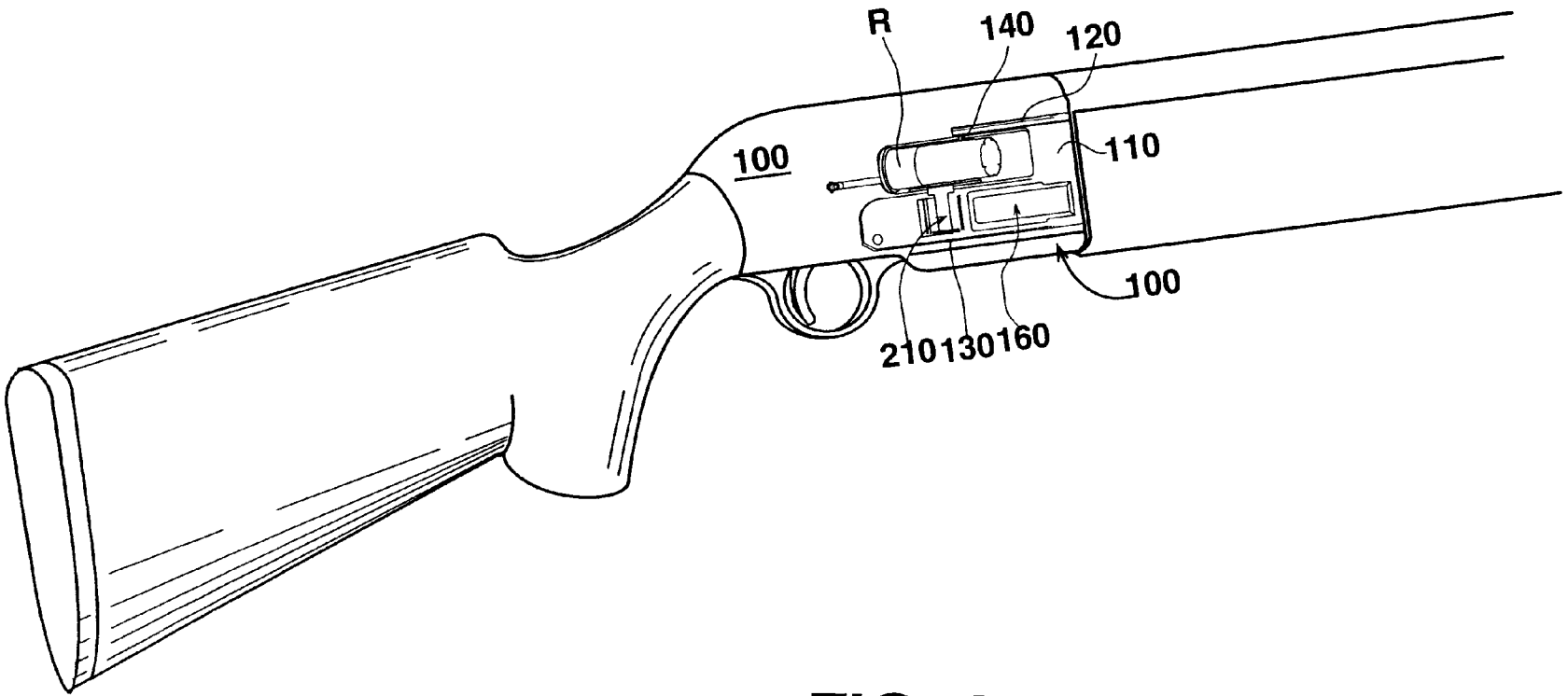
FIG. 4 is a partial perspective view showing the embodiment of the invention depicted in FIGS. 2 and 3 in operation catching a spent shotgun shell.

Typically, plug 140 may be installed in its position on upper section 120 for either double shell shooting or for single shell shooting. In the case of double shell shooting, the shell catcher 210 is removed as discussed below, so that the ejected shells may fly out of the ejection port generally as they normally would, except that the plug 140 gives each shell's travel a downward component so that the shell hits the ground within about a foot of the user. In the case of single shell use, the shell catcher 210 remains in place on the lower section 120, and, upon ejection, the single shell pivots out past the plug 140 and is caught by the catcher 210 for access by the user, as shown in FIG. 4. In this way, in either single-shell or double-shell use, the flexibility of the plug 140 is particularly useful, as the plug bends to allow the shell past it while exerting some force on the shell. The plug 140 is not absolutely necessary for single shell use, as the catcher is effective by itself in catching the shell, but the plug improves overall shell catching performance by slowing the shell and by deflecting it slightly downward so that shell is firmly directed to abut against the shell catcher. Also, after the shell front end pivots out past the plug (the plug flexing rearward) and the shell is "caught" by the rim being retained in the port by the catcher upper portion, the plug helps retain the shell in the "caught" position. The plug does this by preventing the shell from sliding/falling forward far enough forward so that the shell rim can clear the shell catcher. Then, when the user wishes to remove the shell from the gun, he/she may grasp the shell and slide the shell forward past the deflector plug (again flexing the plug, but in the forward direction) to a position forward in the port, ahead of the shell catcher upper portion, where the entire shell and shell rim can easily be removed from the port. Thus, it may be seen that the flexibility of the plug is beneficial in both double and single shell operation, as it: 1) directs the shell in the desired direction and/or slows the shell, without allowing any jamming of the ejection port and in a manner that is reproducible and effective for a variety of differently-sized shells, and 2) it acts as a temporary blocking member to assist in preventing the shell from falling out of the gun when used in combination with the shell catcher.

Plug 140 is preferably installed in the upper section 120 by being pushed/pulled through a bore through the upper section of the frame. Various means may be used to secure it in the bore, but, preferably, the flexible and resilient plug is pulled through the bore, and, when tension is released from it, the plug expands enough in the bore to frictionally hold the plug in the bore. Alternatively, the bore system may include two side-by-side connected bores of different diameters, wherein the plug is first pushed through the larger bore and then moved over sideways to the small bore for final placement. The smaller diameter bore, therefore, holds the plug securely, until the plug is purposely pulled back into the larger bore again and removed.

The plug 140 may be removeable from upper section 120, so the shotgun may be operated without it. Also, plug 140 may be adjustable to move further into or out of the flight path of the shell, thereby making its effect on the ejected shell adjustable. Such adjustment of plug 140 may be made by sliding it in or out, by replacing it with a longer or shorter plug, or by cutting or trimming the existing plug to a shorter length. Also, different plugs of differing flexibility may also be used to make plug 140 adjustable in its performance.

An actuator is connected to the frame so that a distal end of the actuator may be pushed inward against a release button 172 for closing the breech block, wherein the actuator is adapted to be movable against the release button by means of its connection to the frame being a pivotal connection and/or by means of the actuator flexing. In the preferred embodiment, lower section 130 of planar frame 110 has an opening 150 for receiving a breech block latch actuator 160 therein. Actuator 160 is a generally planar panel with a protruding, raised pad 170 on its inner surface for cooperating with the release button on the side of the receiver when combination 100 is attached to the side of a gun. Preferably, latch actuator 160 has a connection 175 near its proximal end for engagement with receiver 190 near the proximal end of opening 150 and planar frame 110. This way, actuator 160 may be easily slid and snapped into receiver 190, and flex easily, especially at its distal end, in and out of the plane of frame 110, thereby actuating the cooperating release button easily. The preferred connection comprises the actuator 160 sliding into the slot of the receiver 190, in the direction of the arrow S in FIG. 2. The receiver includes dovetail component or other members 162 that "overhang" the slot, that is, that extend partially over the proximal end for retaining the proximal end of the actuator in the slot. A. raised ridge 180 protrudes inward from the inner surface of the actuator proximal end and snaps into or is otherwise received by the cooperating channel 192 in the frame. This combination of overhanging members and cooperating ridge and channel retain the actuator in connection with the frame, with enough leeway in the fit of actuator to frame to allow some pivoting of the actuator relative to the frame. The actuator may be made of a slightly flexible material to allow part or all of the action of the actuator relative to the frame to be flexing of the distal end relative to the proximal end of the actuator, to a degree that will let the pad 170 push the release button. Alternatively, other types of connections may be used for the actuator, for example, a pivoting axle system may be used that allows the actuator pivot relative to the frame.

The distal end 194 of the actuator preferably snaps underneath a small overhang 196 in the frame that serves to retain the distal end 194 and prevent it from catching on clothing, equipment, or the user's hands, for example, but does not interfere with the actuator pushing on the release button. With the actuator properly installed in the receiver 190 and underneath the overhand 196, the actuator is free to pivot and/or flex inward but is not likely to be accidentally caught and pulled or pried off of the frame and gun. This way, the actuator may be a safe, trouble-free, and effective actuator for closing the breach block.

Also, lower section 130 of planar frame 110 supports a removable holder 200 for spent shell catcher 210. Removable holder 200 may be called a "dove-tailed" slot in general terms because it includes overhanging members 202 that retain the lower portion 207 of the shell catcher in the holder, as shown by the dashed lines in FIG. 2. The catcher 210 slides down into the holder parallel to the plane of the frame, and may optionally be held there with the aid of a detent mechanism or other latch until purposely removed by the user. For example, the detent mechanism may be designed with a spring-biased ball that holds the shell catcher in the older until the user pushes in and upward on the shell catcher lower potion with the rim of a shell.

When the catcher is thus installed, the upper portion 209 of the shell catcher is held so that it extends into the ejection port only an amount which will allow the breach block to clear the shell catcher during operation. Also, the shape of the shell catcher upper portion must be shaped so that the operating handle 214 of the breach block clears the shell catcher upper portion. An important dimension of the upper portion is its thickness and the resulting amount that the upper portion extends upward toward the bottom edge of the ejection port. This dimension should be adapted so that the distance D between the bottom edge 19 of the port and the top surface of the shell catcher TS is equal to or vary slightly less than the diameter of the shells being used. Distance D is less than the diameter of the shell's rim. In this way, the shell body can be ejected out of the ejection port, but the shell rim R hangs up on the inner side of top surface TS and so is held in the ejection port. The upper portion 209 extends generally parallel to the length of the gun and the port bottom edge. The upper portion of the shell catcher is preferably about 1.5 inches long, which is a length that securely catches the shell rim while leaving room forward of the upper portion for the shell rim to be slid forward to clear the shell catcher for removal of the shell. Preferably, the upper portion 209 is an elongated planar member or "platform" extending parallel to the bottom edge 17 of the port, with, in the preferred embodiment, an upper surface 211 that curves slightly from it's generally horizontal and planar top surface TS (when installed in a gun held by the user) toward the ejection port to the inner edge 217, so that the shell, as it approaches the inner edge 217 and surface 211, "sees" it as a convex surface that effectively catches the shell rim. A longitudinal indentation(not shown) may be supplied running along the entire length of the top surface TS) if needed for clearance of the operating handle.

Thus, in single-shell operation, with the catcher 210 is in place in the holder 200, an ejected shell is pushed outward from the port, and the rim abuts into surface 211 and is caught there, with the shell front end turned about 45 degrees out from the longitudinal axis of the gun, as shown in FIG. 4. As discussed above, the deflector plug 140 may be effective in slowing the shell and directing the shell to lodge on the surface 211 of the upper portion 209. When the gun user decides not to use the catcher 210, he may easily remove it by sliding it upwards out of the holder 200.

Alternative versions of the invented combination unit may include only the actuator and deflector plug, only the deflector plug and catcher, or only the actuator and catcher, as desired by a particular shooter, or as desired for a particular gun. The invented combination unit is adapted particular well for many models of semi-automatic shotguns. The preferred embodiment is designed to fit all Beretta shotguns, Remington model 1100 and 1187 shotguns, Browning Gold shotguns, and all Benelli shotguns. The inventor envisions adjustments in the frame size or shape that would easily adapt the invented unit to other guns. The frame is preferably a substantially planar system that lies close to the surface of the gun on which it is installed, to make it an aesthetically-pleasing unit that does not significantly change the look of the gun, and to make it a safe unit that is not prone to catching on any clothing or equipment. Preferably, the frame is secured to the gun surface by a trigger plate pin (not shown) extending through hole 221 and into the gun surface, which pin is OEM equipment on the gun. A slightly longer-than usual trigger plate pin may be supplied with the combination unit adapted to fit the combination of trigger plate and invented frame. Also, double-sided adhesive is provided to attach the front end of the frame near front edge 223 to the gun surface. The preferred materials for the combination unit frame, actuator, and shell catcher are glass-filled plastic, with the flexible shell deflector preferably being neoprene.

Although this invention has been described above with reference to particular means, materials and embodiments, it is to be understood that the invention is not limited to these disclosed particulars, but extends instead to all equivalents within the scope of the following claims.

I claim:

1. A combination unit for semi-automatic shotgun breach block latch actuating and spent shell handling, the unit comprising:

a frame adapted for attachment to a side surface of a semi-automatic shotgun around a shell ejection port of the shotgun, the port having a top edge, bottom edge, and front and rear edge, the frame having a front section, an upper section extending back from the front section and adapted to extend generally along the shotgun side surface above and along the top edge of the port, and a lower section extending back from the front section and adapted to extend along the shotgun side surface generally below and along the bottom edge of the port; and a spent shell catcher having a lower portion removably connected to the lower section of the frame and having an upper catching portion extending generally perpendicularly from the lower section and adapted to extend a certain distance into the port near the bottom edge of the port, the upper catching portion having a generally planar platform surface facing into the port and adapted to be impacted by spent shells being ejected from the port so that the spent shells stop movement and are retained part way out of the port for access by a user of the shotgun.

2. The unit as in claim 1, further comprising a flexible member extending from the upper section toward the lower section of the frame a distance across the port, wherein the flexible member is adapted to be impacted by a spent shell being ejected from the port, so that the flexible member slows the spent shell and flexes to allow the spent shell to travel past the flexible member in downward and outward path as the spent shell travels away from the gun.

3. The unit as in claim 1, further comprising a pivotal breach block latch actuator movably connected to the lower section of the frame, the actuator being adapted to move toward the frame and the shotgun to contact and actuate a breach block release button.

4. The unit as in claim 2, wherein the flexible member is an elongated plug extending about ¼ inch perpendicularly from the upper section of the frame.

5. The unit as in claim 2, wherein the flexible member is a resilient elongated plug frictionally received and removably held in a bore through the upper section of the frame.

6. The unit as in claim 3, wherein the actuator is a generally flat panel that fits within a front region of the lower section of the frame.

7. The unit as in claim 3, wherein the generally flat panel flexes as a means of moving toward the frame and the shotgun to contact and actuate the breach block release button.

8. The unit as in claim 1, wherein the lower section of the frame has a dove-tailed slot extending transversely to the lower section length, and the shell catcher lower portion removably connects to the frame by sliding down into the slot.

9. The unit as in claim 1, wherein the frame comprises an aperture for receiving a pin extending into the shotgun side surface.

10. The unit as in claim 1, further comprising double-sided adhesive tape for attachment of the frame to the shotgun side surface.

11. The unit as in claim 1, wherein the frame is generally a C-shape with arms extending rearward to form the upper section and the lower section of the frame.

12. A combination unit for semi-automatic shotgun breach block latch actuating and spent shell handling, the unit comprising:

a frame adapted for attachment to a side surface of a semi-automatic shotgun around a shell ejection port of the shotgun, the port having a top edge, bottom edge, and front and rear edge, the frame having a front section, an upper section extending back from the front section and adapted to extend generally along the shotgun side surface above and along the top edge of the port, and a lower section extending back from the front section and adapted to extend generally along the shotgun side surface below and along the bottom edge of the port;

a shell deflector extending from the upper section toward the lower section of the frame a distance across the port, wherein the shell deflector is a flexible elongated member extending generally perpendicularly from the upper section of the frame generally downward toward said lower section, and wherein the shell deflector is adapted to be impacted by a spent shell being ejected from the port, so that the shell deflector slows the spent shell and flexes to allow the spent shell to travel past the shell deflector in downward and outward path as the spent shell travels away from the gun.

13. The combination unit as in claim 12, wherein the shell deflector extends about ¼–½ inch perpendicularly from the upper section of the frame.

14. The combination unit as in claim 12, further comprising a pivotal breach block latch actuator movably connected to the lower section of the frame, the actuator being adapted to move toward the frame and the shotgun to contact and actuate a breach block release button.

15. The unit as in claim 14, wherein the actuator is a generally flat panel that fits within a front region of the lower section of the frame.

16. The unit as in claim 14, wherein the generally flat panel flexes as a means of moving toward the frame and the shotgun to contact and actuate the breach block release button.

17. The unit as in claim 12, wherein the frame comprises an aperture for receiving a pin extending into the shotgun side surface.

18. The unit as in claim 12, further comprising double-sided adhesive tape for attachment of the frame to the shotgun side surface.

19. The unit as in claim 12, wherein the frame is generally a C-shape with arms extending rearward to form the upper section and the lower section of the frame.

* * * * *